US011317217B2

(12) United States Patent
Wang et al.

(10) Patent No.: US 11,317,217 B2
(45) Date of Patent: Apr. 26, 2022

(54) SOUND DEVICE AND PORTABLE TERMINAL

(71) Applicant: GOERTEK INC., Weifang (CN)

(72) Inventors: Xinglong Wang, Weifang (CN); Jianjian Wang, Weifang (CN); Tongyan Xu, Weifang (CN); Chunfa Liu, Weifang (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 17/256,611

(22) PCT Filed: Dec. 17, 2018

(86) PCT No.: PCT/CN2018/121429
§ 371 (c)(1),
(2) Date: Dec. 28, 2020

(87) PCT Pub. No.: WO2020/000930
PCT Pub. Date: Jan. 2, 2020

(65) Prior Publication Data

US 2021/0274289 A1 Sep. 2, 2021

(30) Foreign Application Priority Data

Jun. 25, 2018 (CN) ..... 201810667412.9

(51) Int. Cl.
*H04R 9/06* (2006.01)
*H04R 1/02* (2006.01)
(Continued)

(52) U.S. Cl.
CPC ..... *H04R 9/06* (2013.01); *H04R 1/025* (2013.01); *H04R 1/06* (2013.01); *H04R 7/04* (2013.01);
(Continued)

(58) Field of Classification Search
CPC . H04R 9/06; H04R 1/025; H04R 1/06; H04R 7/04
(Continued)

(56) References Cited

U.S. PATENT DOCUMENTS

2012/0070022 A1* 3/2012 Saiki ..... H04R 9/063 381/312

FOREIGN PATENT DOCUMENTS

CN 2485745 Y 4/2002
CN 102333270 A 1/2012
(Continued)

OTHER PUBLICATIONS

First Chinese Office Action Application No. 201810667412.9; dated Sep. 20, 2019.
(Continued)

*Primary Examiner* — Sean H Nguyen

(57) ABSTRACT

Disclosed are a sound device and a portable terminal. The sound device includes a first vibration system including a bobbin voice coil, the bobbin voice coil being provided behind a first diaphragm and fixedly connected to the first diaphragm, the bobbin voice coil including a bobbin and a voice coil body formed by winding voice coil leads on the bobbin, one end of the bobbin away from the first diaphragm at least partially configured to protrude from the voice coil body; a second vibration system including a second diaphragm opposite to the first diaphragm; and a magnetic circuit system between the first diaphragm and the second diaphragm, the magnetic circuit system being provided with an avoiding portion. One end of the bobbin away from the first diaphragm is movable to penetrate through the avoiding portion and is fixedly connected to the second diaphragm.

14 Claims, 13 Drawing Sheets

(51) Int. Cl.

| | |
|---|---|
| ***H04R 1/06*** | (2006.01) |
| ***H04R 7/04*** | (2006.01) |
| ***H04R 9/02*** | (2006.01) |
| ***H04R 9/04*** | (2006.01) |
| ***H04R 7/18*** | (2006.01) |

(52) U.S. Cl.
CPC ..... *H04R 9/025* (2013.01); *H04R 9/046* (2013.01); *H04R 7/18* (2013.01); *H04R 2499/11* (2013.01)

(58) Field of Classification Search
USPC ..... 381/334
See application file for complete search history.

(56) References Cited

FOREIGN PATENT DOCUMENTS

| | | | |
|---|---|---|---|
| CN | 103747392 | A | 4/2014 |
| CN | 204887453 | U | 12/2015 |
| CN | 106303851 | A | 1/2017 |
| CN | 108566606 | A | 9/2018 |
| EP | 1420610 | A1 | 5/2004 |
| WO | 2013023414 | A1 | 2/2013 |

OTHER PUBLICATIONS

International Search Report PCT/CN2018/121429; dated Mar. 28, 2019.
Written Opinion PCT/CN2018/121429; dated Mar. 28, 2019.

* cited by examiner

SOUND DEVICE AND PORTABLE TERMINAL

CROSS-REFERENCE TO RELATED APPLICATIONS

This application is a National Stage of International Application No. PCT/CN2018/121429, filed on Dec. 17, 2018, which claims priority to Chinese Application No. 201810667412.9, filed on Jun. 25, 2018, the entire disclosure of which is incorporated herein by reference.

TECHNICAL FIELD

The present disclosure relates to the technical field of electroacoustic technology, in particular to a sound device and a portable terminal applying the sound device.

BACKGROUND

Nowadays, as an important part of a terminal with audio playback function, the speaker has been widely used. Some terminals, especially portable terminals, such as mobile phones, tablet computers, and earphones, can provide very limited installation space for the speaker. Therefore, the existing speakers that can be applied to a narrow installation space usually adopts a structure with a single diaphragm that emits sound from the front.

In order to achieve bidirectional sounding, a speaker using two sets of voice coil and magnetic circuit system has appeared in the related art. Due to its own structural design, such a speaker is usually relatively large in size. For existing portable terminals with a small installation space, such speaker design is difficult to be widely used.

SUMMARY

The main purpose of the present disclosure is to provide a sound device, which aims to solve the technical problem that the existing sound device for bidirectional sounding is difficult to be widely used due to its large size.

In order to achieve the above objective, the present disclosure provides a sound device, including:

a first vibration system including a bobbin voice coil, the bobbin voice coil being provided behind a first diaphragm and fixedly connected to the first diaphragm, the bobbin voice coil including a bobbin and a voice coil body formed by winding voice coil leads on the bobbin, one end of the bobbin away from the first diaphragm at least partially configured to protrude from the voice coil body;

a second vibration system including a second diaphragm opposite to the first diaphragm; and a magnetic circuit system between the first diaphragm and the second diaphragm, the magnetic circuit system being provided with an avoiding portion, one end of the bobbin away from the first diaphragm is movable to penetrate through the avoiding portion and is fixedly connected to the second diaphragm.

In an embodiment, the magnetic circuit system includes a magnetic conductive yoke and a center magnetic circuit portion and a side magnetic circuit portion provided on the magnetic conductive yoke at least one of the center magnetic circuit portion and the side magnetic circuit portion is provided with a permanent magnet; a magnetic gap for receiving the bobbin voice coil is provided between the center magnetic circuit portion and the side magnetic circuit portion and the magnetic conductive yoke is provided with the avoiding portion at a position corresponding to the bobbin voice coil.

In an embodiment, a first acoustic cavity is provided between the magnetic circuit system and the first diaphragm, a second acoustic cavity is provided between the magnetic circuit system and the second diaphragm, and the avoiding portion is in communication with the first acoustic cavity and the second acoustic cavity.

In an embodiment, the magnetic conductive yoke includes two long sides opposite to each other and two short sides, the long side and the short side are spaced apart, the center magnetic circuit portion is located in a middle of the magnetic conductive yoke, the side magnetic circuit portions is located on opposite sides of the center magnetic circuit portion and extending along the long sides, a position of the magnetic conductive yoke corresponding to each of the two short sides is provided with an avoiding notch to form the avoiding portion, the bobbin includes a supporting portion and a connecting portion, the supporting portion is wound with the voice coil leads to form the voice coil body, the connecting portion is connected to the supporting portion and protruded from the voice coil body, and the connecting portion is configured to pass through the avoiding notch and is fixedly connected to the second diaphragm.

In an embodiment, a side wall of the connecting portion is folded towards inside the bobbin and/or towards outside the bobbin to form a connecting flange, and a bottom surface of the connecting flange away from the supporting portion is fixedly connected to the second diaphragm.

In an embodiment, a plurality of connecting flanges are spaced apart, and folding directions of two adjacent connecting flanges are identical or different.

In an embodiment, a side wall of the supporting portion is folded towards inside the bobbin and/or towards outside the bobbin to form a mounting flange, and a bottom surface of the mounting flange away from the connecting portion is fixedly connected to the first diaphragm.

In an embodiment, an end surface of the supporting portion close to the first diaphragm is flush with an end surface of the voice coil body close to the first diaphragm, or an end surface of the supporting portion close to the first diaphragm is higher than an end surface of the voice coil body close to the first diaphragm.

In an embodiment, an end surface of the supporting portion away from the first diaphragm is flush with an end surface of the voice coil body away from the first diaphragm, or an end surface of the supporting portion away from the first diaphragm is not higher than an end surface of the voice coil body away from the first diaphragm.

In an embodiment, an opening is further provided on a side wall of the supporting portion.

In an embodiment, an avoiding hole is further provided on a side wall of the connecting portion.

In an embodiment, the first diaphragm includes a center portion, a folding ring portion around the center portion, and a fixing portion around the folding ring portion; and the center portion is a flat sheet structure, the folding ring portion is a structure composed of a protrusion, or the folding ring portion is a wave-shaped structure composed of at least one protrusion and at least one recess.

In an embodiment, the second diaphragm includes a center portion, a folding ring portion around the center portion, and a fixing portion around the folding ring portion; and the center portion is a flat sheet structure, the folding ring portion is a structure composed of a protrusion, or the folding ring portion is a wave-shaped structure composed of at least one protrusion and at least one recess.

The present disclosure further provides a portable terminal. The portable terminal includes a housing with a receiving cavity inside. The portable terminal further includes the sound device as described above. The sound device is installed in the receiving cavity. The housing is provided with a first sound hole corresponding to the first diaphragm and a second sound hole corresponding to the second diaphragm.

In an embodiment, the housing includes a front surface and a back surface opposite to the front surface, the first sound hole is provided on the front surface, and the second sound hole is provided on the back surface.

In the present disclosure, the sound device includes two sets of vibration systems and a set of magnetic circuit system. The first vibration system includes a bobbin voice coil and a first diaphragm fixed to the bobbin voice coil. The bobbin of the bobbin voice coil protrudes from the voice coil body, and the second diaphragm in the second vibration system is fixedly connected to the part of the bobbin protruding from the voice coil body. Meanwhile, an avoiding portion matched with the bobbin is provided in the magnetic circuit system. As such when the sound device is working, the first diaphragm in the first vibration system is directly driven by the action of the magnetic circuit system on the voice coil to vibrate and then produce sound. Driven by the conduction of the bobbin voice coil, the second diaphragm in the second vibration system is linked to produce sound simultaneously. Since the present disclosure can drive two diaphragms to achieve bidirectional sounding through a voice coil bobbin and a set of magnetic circuit system, the structure of the sound device between the first diaphragm and the second diaphragm occupies a small volume, which can adapt to a relatively small installation space, and is convenient for being widely used in portable terminals.

BRIEF DESCRIPTION OF THE DRAWINGS

In order to more clearly illustrate the embodiments of the present disclosure, drawings used in the embodiments will be briefly described below. Obviously, the drawings in the following description are only some embodiments of the present disclosure. It will be apparent to those skilled in the art that other figures can be obtained according to the structures shown in the drawings without creative work.

DESCRIPTION OF REFERENCE NUMBERS

Figure 1:
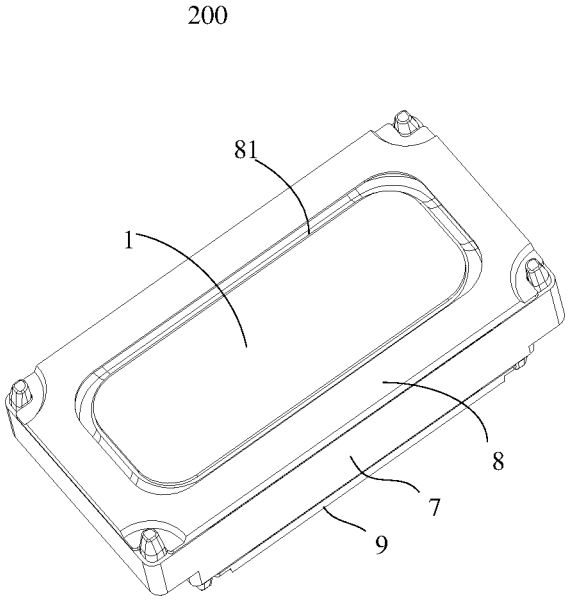
FIG. 1 is a schematic front view of a sound device according to an embodiment of the present disclosure.
Figure 2:
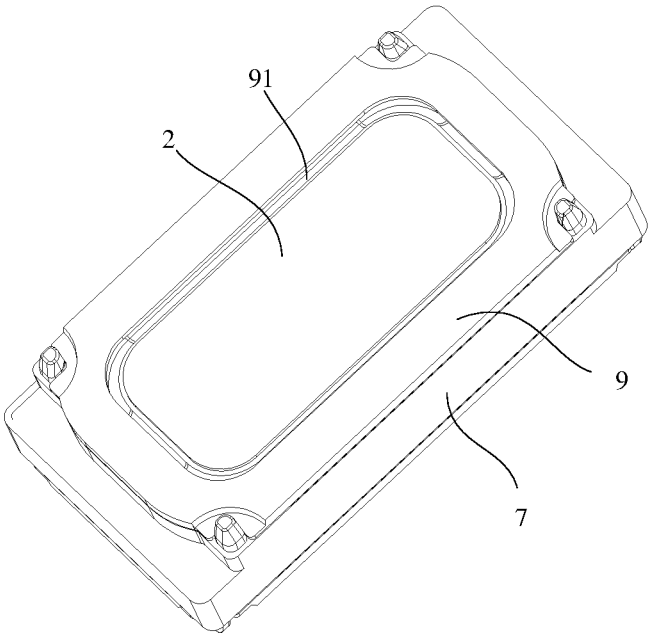
FIG. 2 is a schematic rear view of the sound device in FIG. 1.

1: first vibration system; 11: first diaphragm; 12: bobbin voice coil; 2: second vibration system; 21*a*, 21*b*: second diaphragm; 211*a*, 211*b*: center portion; 212*a*, 212*b*: folding ring portion; 213*a*, 213*b*: fixing portion; 3: magnetic circuit system; 31: magnetic conductive yoke; 311: long side; 313: short side; 315: avoiding notch; 32: center magnet; 33: sub-magnet; 34: center magnetic conductive plate; 35: side magnetic conductive plate; 36: magnetic gap; 12: bobbin voice coil; 121: voice coil body; 122: bobbin; 123: supporting portion; 1231: mounting flange; 1232: opening; 124: connecting portion; 1241: connecting flange; 1242: avoiding hole; 7: housing; 8: front cover; 81: front sound hole; 9: rear cover; 91: rear sound hole; 100: portable terminal; 110: housing; 120: receiving cavity; 130: first sound hole; 140: second sound hole; 200: sound device.

The realization of the objective, functional characteristics, and advantages of the present disclosure are further described with reference to the accompanying drawings.

DETAILED DESCRIPTION OF THE EMBODIMENTS

The technical solutions of the embodiments of the present disclosure will be described in more detail below with reference to the accompanying drawings. It is obvious that the embodiments to be described are only some rather than all of the embodiments of the present disclosure. All other embodiments obtained by persons skilled in the art based on the embodiments of the present disclosure without creative efforts shall fall within the scope of the present disclosure.

It should be noted that if there is a directional indication (such as up, down, left, right, front, rear . . . ) in the embodiments of the present disclosure, the directional indication is only used to explain the relative positional relationship, movement, etc. of the components in a certain posture (as shown in the drawings). If the specific posture changes, the directional indication will change accordingly.

In the present disclosure, unless otherwise clearly specified and limited, the terms "connected", "fixed", etc. should be interpreted broadly. For example, "fixed" can be a fixed connection, a detachable connection, or a whole; can be a mechanical connection or an electrical connection; may be directly connected, or indirectly connected through an intermediate medium, and may be the internal communication between two elements or the interaction relationship between two elements, unless specifically defined otherwise. For those of ordinary skill in the art, the specific meaning of the above-mentioned terms in the present disclosure can be understood according to specific circumstances.

Besides, the descriptions associated with, e.g., "first" and "second," in the present disclosure are merely for descriptive purposes, and cannot be understood as indicating or suggesting relative importance or impliedly indicating the number of the indicated technical feature. Therefore, the feature associated with "first" or "second" can expressly or impliedly include at least one such feature. In addition, the technical solutions between the various embodiments can be combined with each other, but they must be based on the realization of those of ordinary skill in the art. When the combination of technical solutions is contradictory or cannot be achieved, it should be considered that such a combination of technical solutions does not exist, nor is it within the scope of the present disclosure.

The present disclosure provides a sound device 200.

In an embodiment of the present disclosure, as shown in FIG. 1 to FIG. 9, the sound device 200 includes a first vibration system 1, a second vibration system 2, and a magnetic circuit system 3.

The first vibration system 1 includes a first diaphragm 11 and a bobbin voice coil 12 provided behind the first diaphragm 11. The bobbin voice coil 12 includes a bobbin 122 and a voice coil body 121 formed by winding voice coil leads on the bobbin 122. One end of the bobbin 122 away from the first diaphragm 11 is at least partially configured to protrude from the voice coil body 121. The second vibration system 2 includes a second diaphragm (21*a*, 21*b*) opposite to the first diaphragm 11.

The magnetic circuit system 3 is provided between the first diaphragm 11 and the second diaphragm (21*a*, 21*b*), and the magnetic circuit system 3 is provided with an avoiding portion. One end of the bobbin 122 away from the first diaphragm 11 is movable to penetrate through the avoiding portion and is fixedly connected to the second diaphragm (21*a*, 21*b*).

In this embodiment, to simplify the description, a position when the first diaphragm 11 of the sound device 210 is placed upward is used as a reference to define upper and lower sides. That is, a side of the first diaphragm 11 away from the magnetic circuit system 3 is upper, and a side of the first diaphragm 11 facing the magnetic circuit system 3 is lower.

The first vibration system 1 can refer to the existing form. Specifically, the bobbin voice coil 12 is fixedly connected to the first diaphragm 11 and extends into the magnetic gap 36, and the bobbin voice coil 12 is supplied with the alternating current and vibrated by different magnitudes of ampere force. The vibration of the bobbin voice coil 12 drives the first diaphragm 11 to vibrate, and its energy conversion method is electrical energy-mechanical energy-sound energy. In order to adjust the frequency characteristics of the vibration, the first vibration system 1 may further include a counterweight.

The connection between the bobbin voice coil 12 and the first diaphragm 11 or the second diaphragm (21*a*, 21*b*) may be glue bonding, or integral injection molding connection, or other methods. The first diaphragm 11 and the second diaphragm (21*a*, 21*b*) are provided with a composite portion, that is, a dome, and the bobbin voice coil 12 may be connected to the composite portion. The shape of the composite portion may be a flat plate, an uneven device, or a dome shape. In order to reduce the weight of components while ensuring strength, a material of the bobbin 122 in the bobbin voice coil 12 includes but is not limited to paper, Kapton (polyimide (PI) film material), foam material, carbon fiber material, metal materials such as aluminum foil/magnesium aluminum alloy/magnesium lithium alloy, plastic materials such as polyethylene naphthalate (PEN)/polyimide (PI)/liquid crystal polymer (LCP)/polycarbonate/polyphthalamide (PPA), or porous materials, etc. The methods for processing connectors (4*a*-4*e*) include but are not limited to: winding, blow molding, injection molding, stamping, machining, and 3D printing.

In order to facilitate the installation of the first vibration system 1, the second vibration system 2 and the magnetic circuit system 3 between the first vibration system 1 and the second vibration system 2, the sound device 200 further includes a housing 7, a front cover 8 and a rear cover 9. The housing 7 is configured to house the first vibration system 1, the second vibration system 2 and the magnetic circuit system 3. The front cover 8 and the rear cover 9 cooperate with the housing 7 to form a protective frame. Specifically, an edge of the first diaphragm 11 for fixing is clamped by the front cover 8 and the housing 7. An edge of the second diaphragm (21*a*, 21*b*) for fixing is clamped by the back cover 9 and the housing 7. The front cover 8 corresponds to the first vibration system 1 and is provided with a front sound hole 81 for sound emission. The rear cover 9 corresponds to the second vibration system 2 and is provided with a rear sound hole 91 for sound emission.

In the present disclosure, the sound device 200 includes two sets of vibration systems and a set of magnetic circuit system. The first vibration system 1 includes a bobbin voice coil 12 and a first diaphragm 11 fixed to the bobbin voice coil 12. The bobbin 122 of the bobbin voice coil 12 protrudes from the voice coil body 121, and the second diaphragm (21*a*, 21*b*) in the second vibration system 2 is fixedly connected to a part of the bobbin 122 protruding from the voice coil body 121. Meanwhile, an avoiding portion matched with the bobbin 122 is provided in the magnetic circuit system. As such when the sound device 200 is working, the first diaphragm 11 in the first vibration system 1 is directly driven by the action of the magnetic circuit system 3 on the bobbin voice coil 12 to vibrate and then produce sound. The part of the bobbin voice coil 12 protruding from the voice coil body 121 can drive the second diaphragm (21*a*, 21*b*) in the second vibration system 2 to produce sound simultaneously. Since the present disclosure can drive two diaphragms to achieve bidirectional sounding through a voice coil bobbin and a set of magnetic circuit system, the structure of the sound device 200 between the first diaphragm 11 and the second diaphragm (21*a*, 21*b*) occupies a small volume, which can adapt to a relatively small installation space, and is convenient for being widely used in portable terminals.

Figure 7:
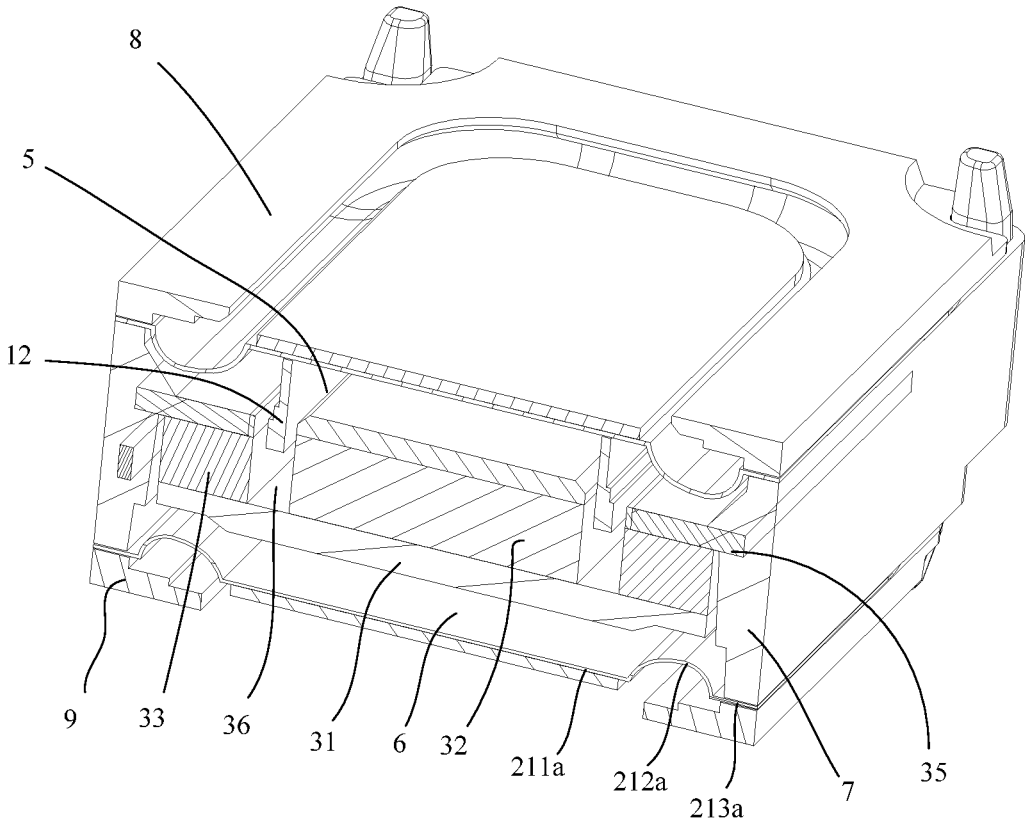
FIG. 7 is a schematic cross-sectional view of the sound device in FIG. 1 along a width direction.
Figure 8:
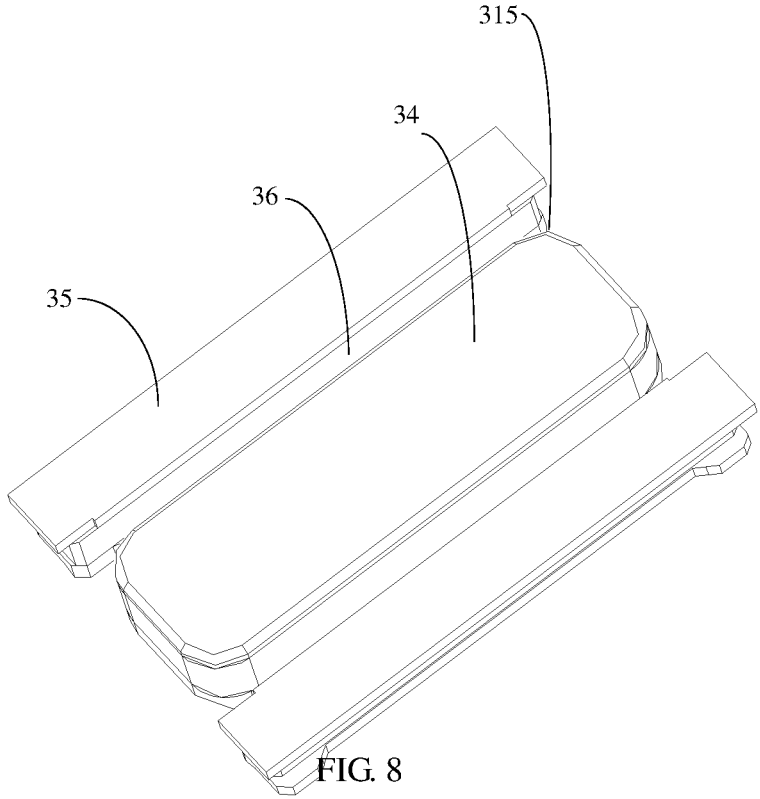
FIG. 8 is a schematic front view of a assembly structure of the magnetic circuit system of the sound device in FIG. 1.

Further, the magnetic circuit system includes a magnetic conductive yoke 31 and a center magnetic circuit portion and a side magnetic circuit portion provided on the magnetic conductive yoke 31. As shown in FIG. 7 and FIG. 8, a magnetic gap 36 for receiving the bobbin voice coil 12 is provided between the center magnetic circuit portion and the side magnetic circuit portion. At least one of the center magnetic circuit portion and the side magnetic circuit portion is provided with a permanent magnet. The bobbin voice coil 12 is received in the magnetic gap 36 of the magnetic circuit system 3, and the magnetic conductive yoke 31 is provided with the avoiding portion corresponding to a position of the bobbin voice coil 12. One end of the bobbin 122 away from the first diaphragm 11 passes through the avoiding portion and is fixedly connected to the second diaphragm (21*a*, 21*b*). One end of the bobbin 122 close to the first diaphragm 11 is connected to the first diaphragm 11. The part of the bobbin 122 protruding from the voice coil body 121 can pass through the avoiding portion to be connected to the second diaphragm (21*a*, 21*b*). Therefore, when the bobbin voice coil 12 vibrates, the bobbin voice coil 12 can not only drive the first diaphragm 11 to vibrate, but also drive the second diaphragm (21*a*, 21*b*) to vibrate, such that while the first diaphragm 11 vibrates and produces sound, the second diaphragm (21*a*, 21*b*) is linked to produce sound.

The form of the magnetic circuit system can also refer to the existing structure. For example, the magnetic gap 36 may be formed between the center magnet 32 and the side magnets 33, or between the center magnet 32 and the side wall of the magnetic conductive yoke 31. The plan view shape of the center magnet 32 may be a circle or a rounded rectangle or the like.

Further, a first acoustic cavity 5 is formed between the magnetic circuit system 3 and the first diaphragm 11, and a second acoustic cavity 6 is formed between the magnetic circuit system 3 and the second diaphragm (21*a*, 21*b*). The avoiding portion is in communication with the first acoustic cavity 5 and the second acoustic cavity 6. While the first diaphragm 11 and the second diaphragm (21*a*, 21*b*) sound in conjunction, since the avoiding portion communicates with the first acoustic cavity 5 and the second acoustic cavity 6, the air in the sound device 200 can circulate with each other, the air pressure difference between the first acoustic cavity 5 and the second acoustic cavity 6 is small, and the resistance caused to the vibration of the first diaphragm 11 and the second diaphragm (21*a*, 21*b*) is also relatively small, so that better acoustic performance can be achieved.

Figure 3:
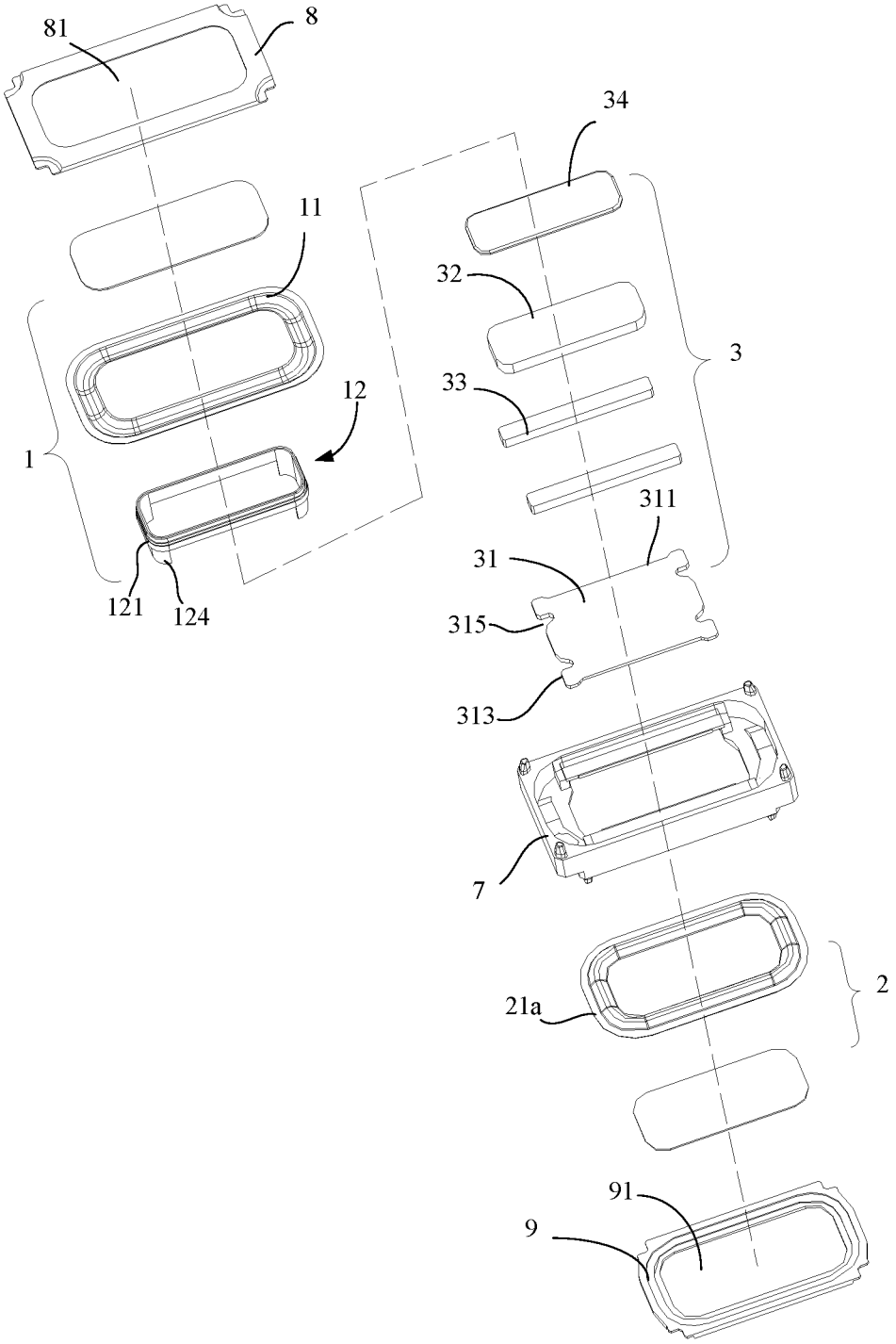
FIG. 3 is an exploded schematic view of the sound device in FIG. 1, in which a first embodiment of a bobbin voice coil is shown.
Figure 4:
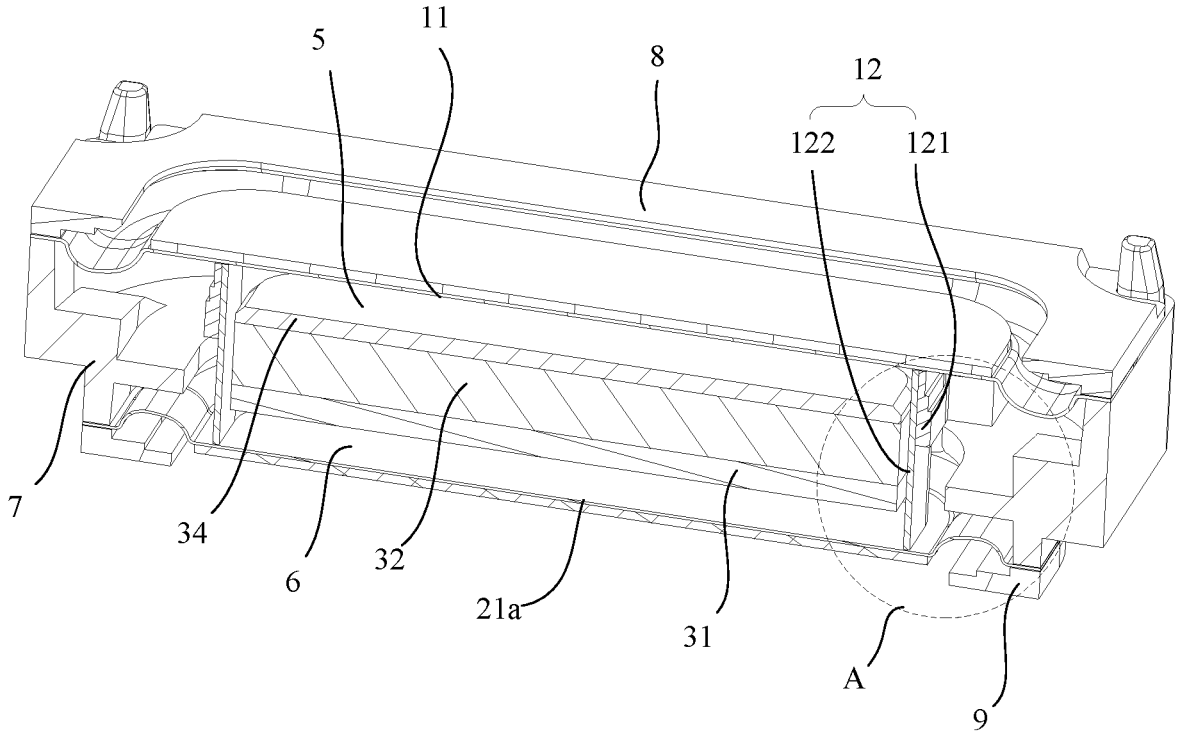
FIG. 4 is a schematic cross-sectional view of the sound device in FIG. 1 along a length direction.
Figure 5:
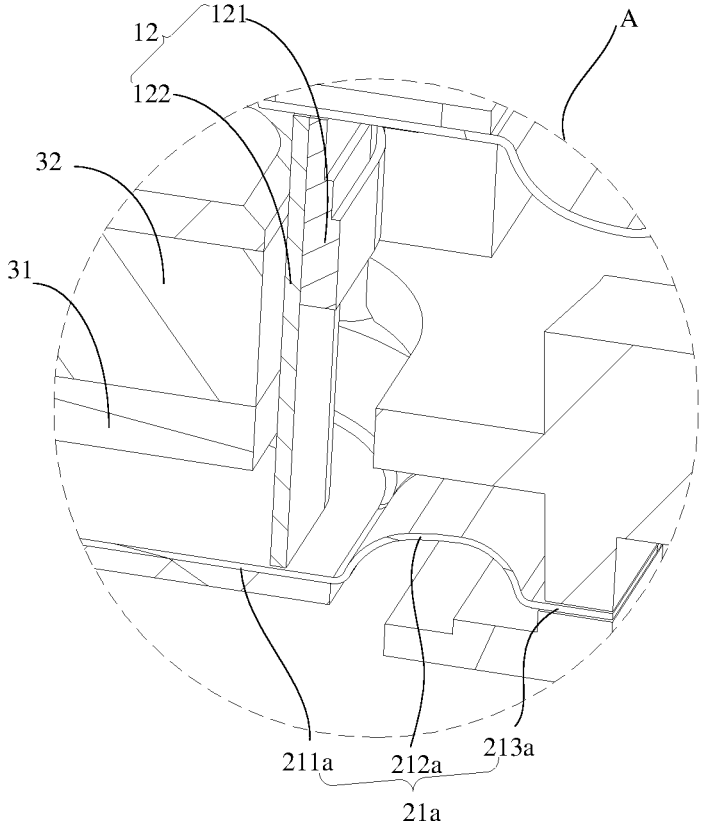
FIG. 5 is a partial enlarged view of portion A in FIG. 4.
Figure 9:
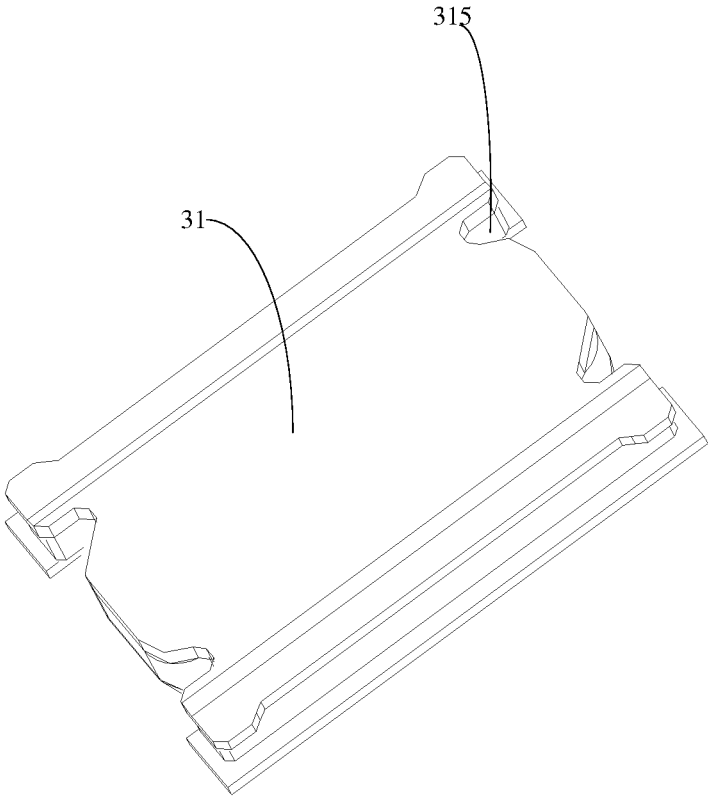
FIG. 9 is a schematic rear view of the assembly structure of the magnetic circuit system of the sound device in FIG. 1.
Figure 10:
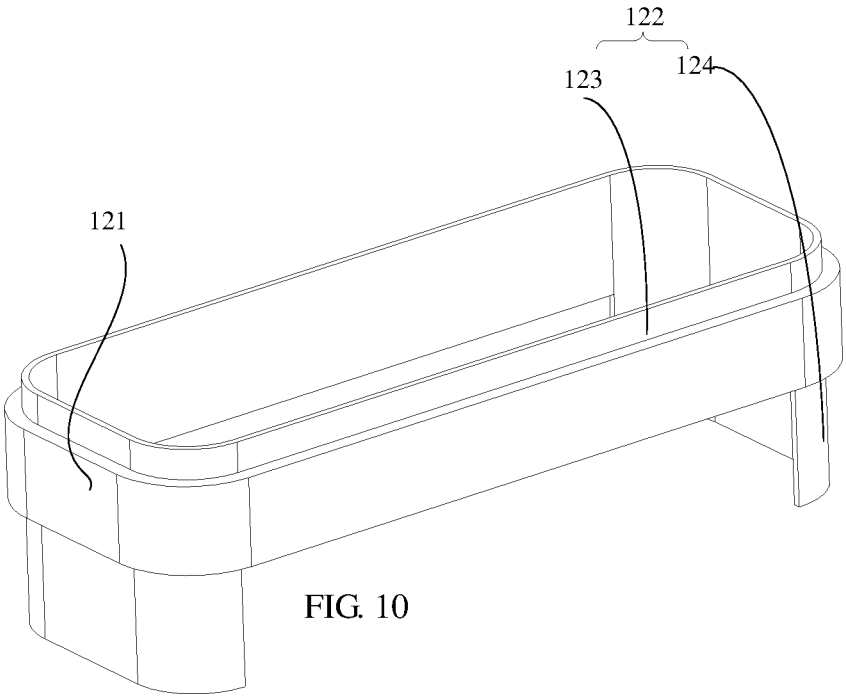
FIG. 10 is a schematic view of the bobbin voice coil of the sound device according to a first embodiment of the present disclosure.
Figure 11:
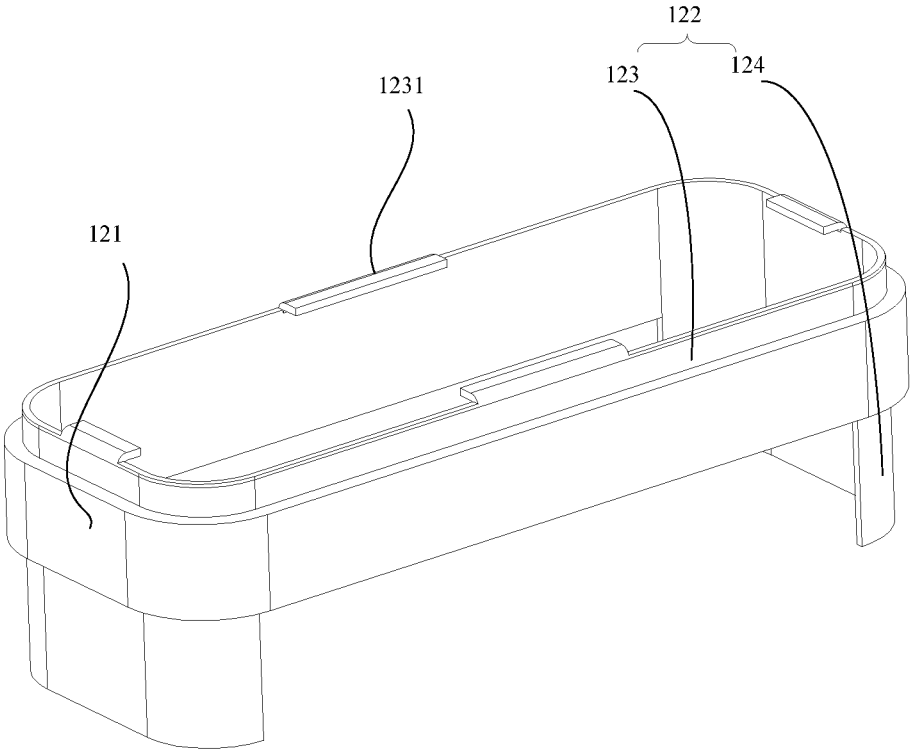
FIG. 11 is a schematic view of the bobbin voice coil of the sound device according to a second embodiment of the present disclosure.

As shown in FIG. 3, FIG. 8 and FIG. 9, the magnetic conductive yoke 31 includes two long sides 311 opposite to each other and two short sides 313, the long side 311 and the short side 313 are spaced apart. The center magnetic circuit portion is located in a middle of the magnetic conductive yoke 31, the side magnetic circuit portions is located on opposite sides of the center magnetic circuit portion and extending along the long side 311. A position of the magnetic conductive yoke 31 corresponding to each of the two short sides 313 is provided with an avoiding notch 315 to form the avoiding portion. The bobbin 122 includes a supporting portion 123 and a connecting portion 124, the supporting portion 123 is wound with voice coil leads to form the voice coil body 121, the connecting portion 124 is connected to the supporting portion 123 and configured to protrude from the voice coil body 121, and the connecting portion 124 is configured to pass through the avoiding notch 315 and is fixedly connected to the second diaphragm (21*a*, 21*b*).

Specially, the magnetic conductive yoke 31 has an approximate rectangular shape as a whole. The center magnetic circuit portion and the side magnetic circuit portion are elongated. The center magnetic circuit portion specifically includes a center magnet 32 and a center magnetic conductive plate 34 covering the center magnet 32. The side magnetic circuit portion includes a sub-magnet 33 and a side magnetic conductive plate 35 installed on the sub-magnet 33. The bobbin voice coil 12 is also enclosed in an approximate rectangular parallelepiped shape with chamfers. Two side magnetic circuits and a center magnetic circuit portion form a three magnetic circuit system. Avoiding notches 315 are provided at both short sides 313 of the magnetic conductive yoke 31. Each avoiding notch 315 is movable through a connecting portion 124. In this way, during the operation of the sound device 200, the opposite sides of the bobbin voice coil 12 simultaneously act on the second diaphragm (21*a*, 21*b*) through the connecting portion 124. Therefore, the second diaphragm (21*a*, 21*b*) is more uniform in force, and the consistency of the synchronous movement with the first diaphragm 11 is higher, and the sound quality of the bidirectional sound of the sound device 200 is better. The avoiding portion shown in the Figures is notched. In other embodiments, the avoiding portion may also be a hole-like structure provided at the two short sides 313 for the connecting portion 124 to pass through. It can be understood that the above bidirectional sounding structure of the present disclosure can also be applied to a single magnetic circuit system.

As shown in FIG. 4, FIG. 5, FIG. 10 and FIG. 11, according to a first embodiment and a second embodiment of the present disclosure, an end surface of the supporting portion 123 close to the first diaphragm 11 is flush with an end surface of the voice coil body 121 close to the first diaphragm 11, or an end surface of the supporting portion 123 close to the first diaphragm 11 is higher than an end surface of the voice coil body 121 close to the first diaphragm 11. When the end surface of the supporting portion 123 close to the first diaphragm 11 is flush with the end surface of the voice coil body 121 close to the first diaphragm 11, the bobbin voice coil 12 and the first diaphragm 11 have a larger connection contact area (at this time, the end surfaces of the voice coil body 121 and the bobbin 122 may be connected to the first diaphragm 11 at the same time), for example, when the connection is made by adhesive, the adhesion is greater and the connection is more reliable. When the end surface of the supporting portion 123 close to the first diaphragm 11 is higher than the end surface of the voice coil body 121 close to the first diaphragm 11, it is convenient for the performance debugging of the sound device 200 during the assembly process.

Further, in order to further improve the stability of the connection structure between the bobbin voice coil 12 and the first diaphragm 11, in the present disclosure, a side wall of the supporting portion 123 is folded towards inside the bobbin 122 and/or towards outside the bobbin 122 to form a mounting flange 1231, and a bottom surface of the mounting flange 1231 away from the connecting portion 124 is fixedly connected to the first diaphragm 11. The mounting flange 1231 can further increase the connection contact area between the end surface of the supporting portion 123 and the first diaphragm 11. As such, the adhesion force is greater.

Figure 12:
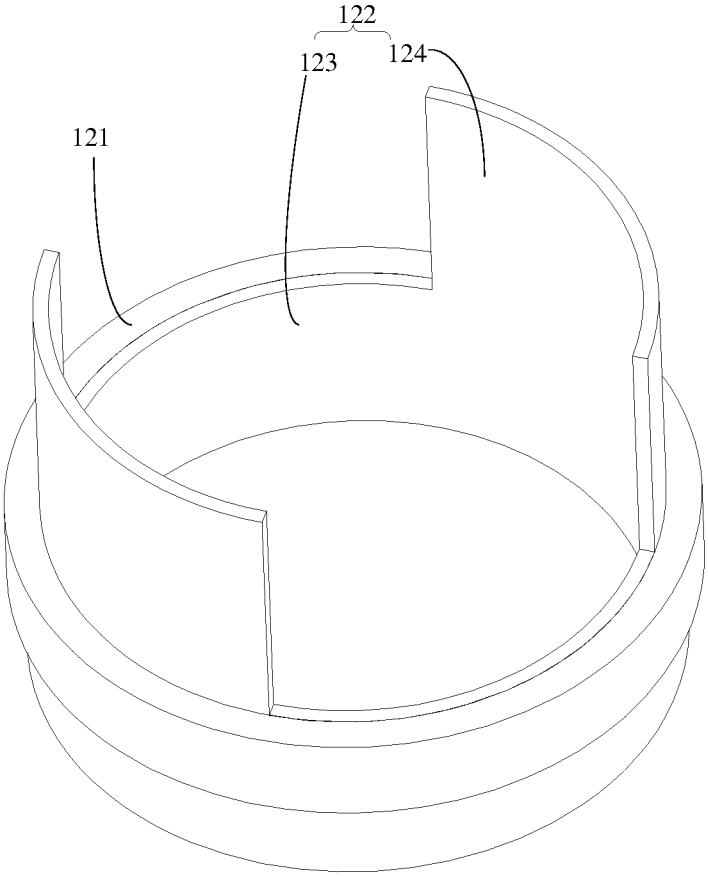
FIG. 12 is a schematic view of the bobbin voice coil of the sound device according to a third embodiment of the present disclosure.
Figure 13:
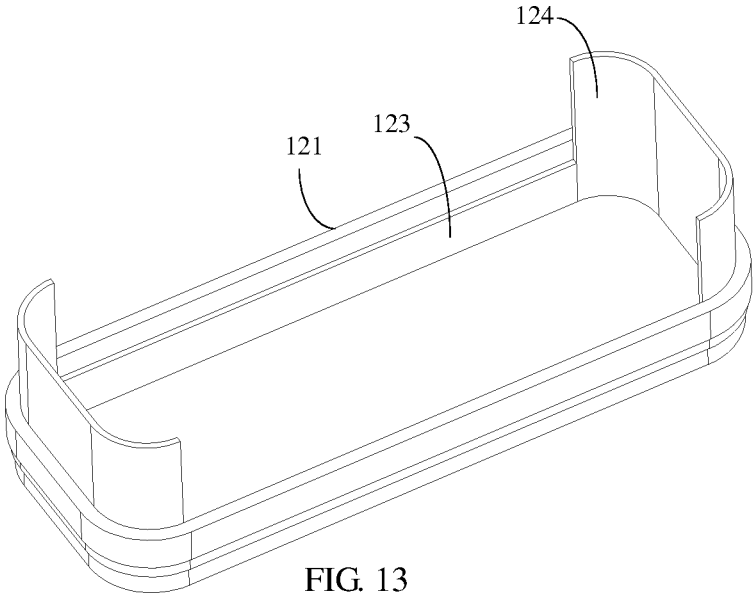
FIG. 13 is a schematic view of the bobbin voice coil of the sound device according to a fourth embodiment of the present disclosure.

It can be seen from the above that the bidirectional sounding structure of the present disclosure can be applied to a single magnetic circuit system or a multi-magnetic circuit system (especially a three magnetic circuit system). As shown in FIG. 12 and FIG. 13, the bobbin voice coil 12 may be circular or racetrack-shaped. The projection of the supporting portion 123 on a horizontal plane may be approximately a circle or a square, and the connecting portion 124 is arranged oppositely, for example, at a short side of the square supporting portion 123.

Figure 14:
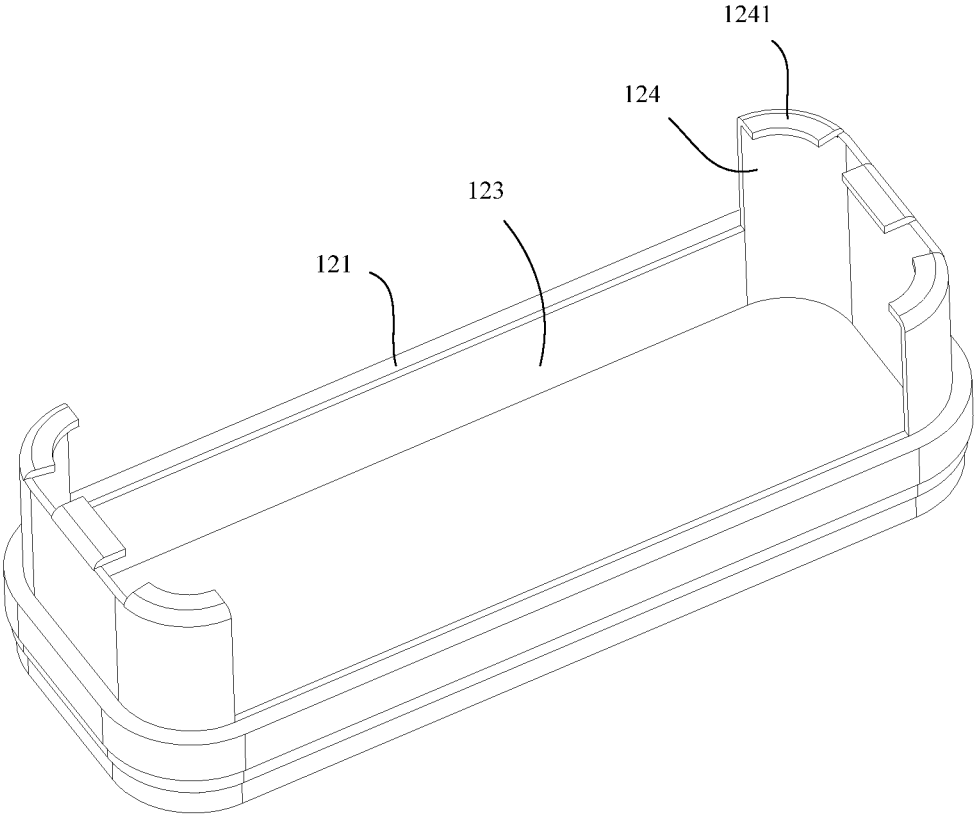
FIG. 14 is a schematic view of the bobbin voice coil of the sound device according to a fifth embodiment of the present disclosure.
Figure 15:
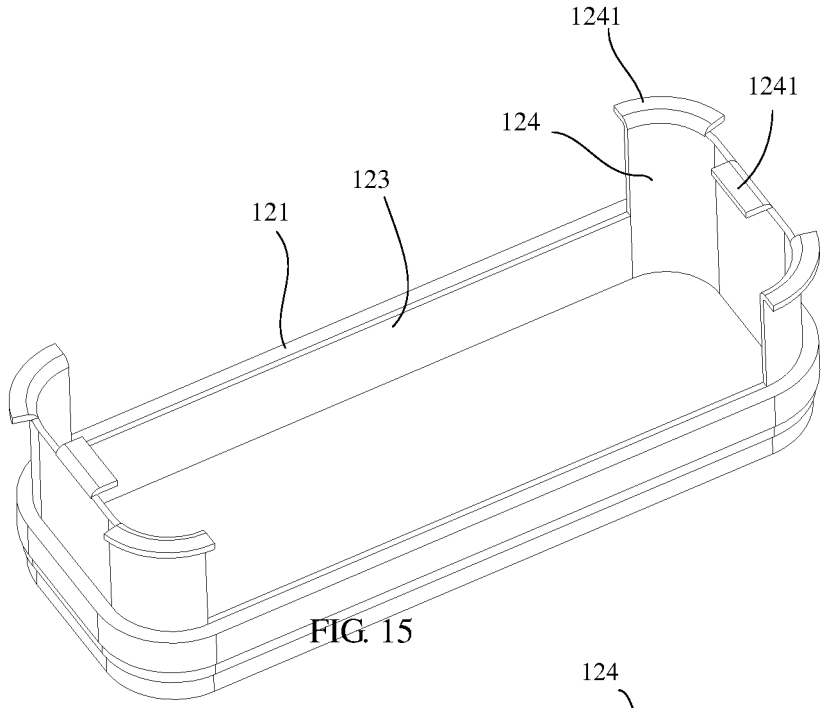
FIG. 15 is a schematic view of the bobbin voice coil of the sound device according to a sixth embodiment of the present disclosure.

As shown in FIG. 14 and FIG. 15, in order to improve the stability of the connection structure between the bobbin voice coil 12 and the second diaphragm (21*a*, 21*b*), according to a fifth embodiment and a sixth embodiment of the present disclosure, a side wall of the connecting portion 124 is folded towards inside the bobbin 122 and/or towards outside the bobbin 122 to form a connecting flange 1241, and a bottom surface of the connecting flange 1241 away from the supporting portion 123 is fixedly connected to the second diaphragm (21*a*, 21*b*). Further, a plurality of the connecting flanges 1241 are spaced apart, and folding directions of two adjacent connecting flanges 1241 are identical or different. The connecting flange 1241 can further increase the connection contact area between the end surface of the connecting portion 124 and the second diaphragm (21*a*, 21*b*). As such, the adhesion force is greater and the connection is more stable.

Figure 16:
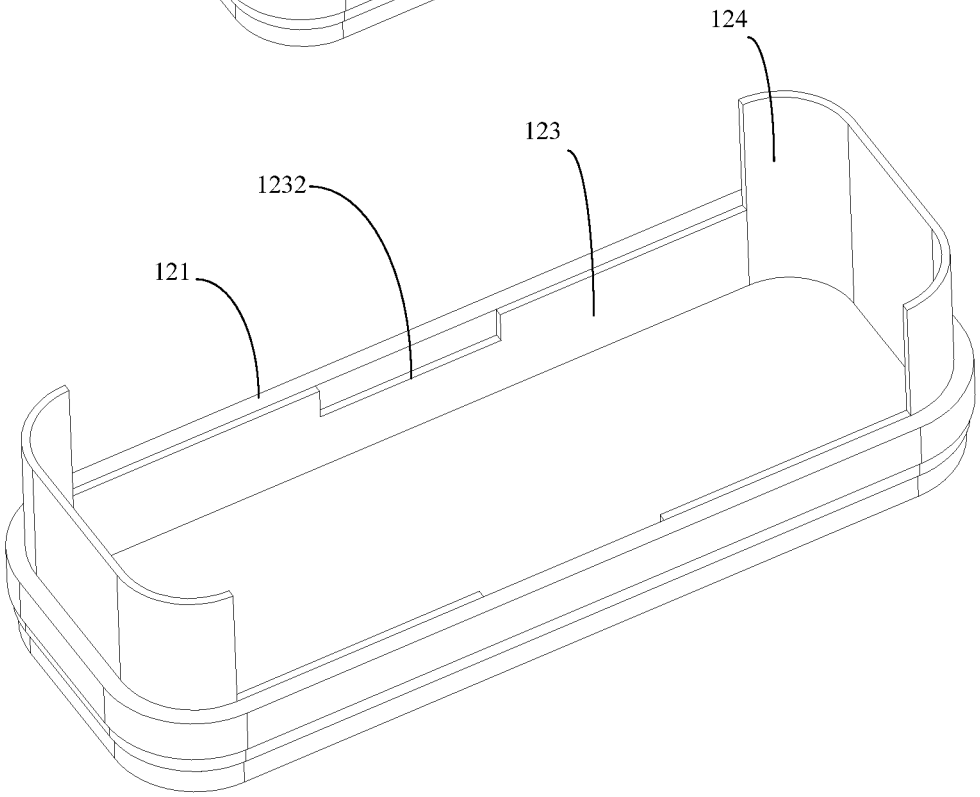
FIG. 16 is a schematic view of the bobbin voice coil of the sound device according to a seventh embodiment of the present disclosure.
Figure 17:
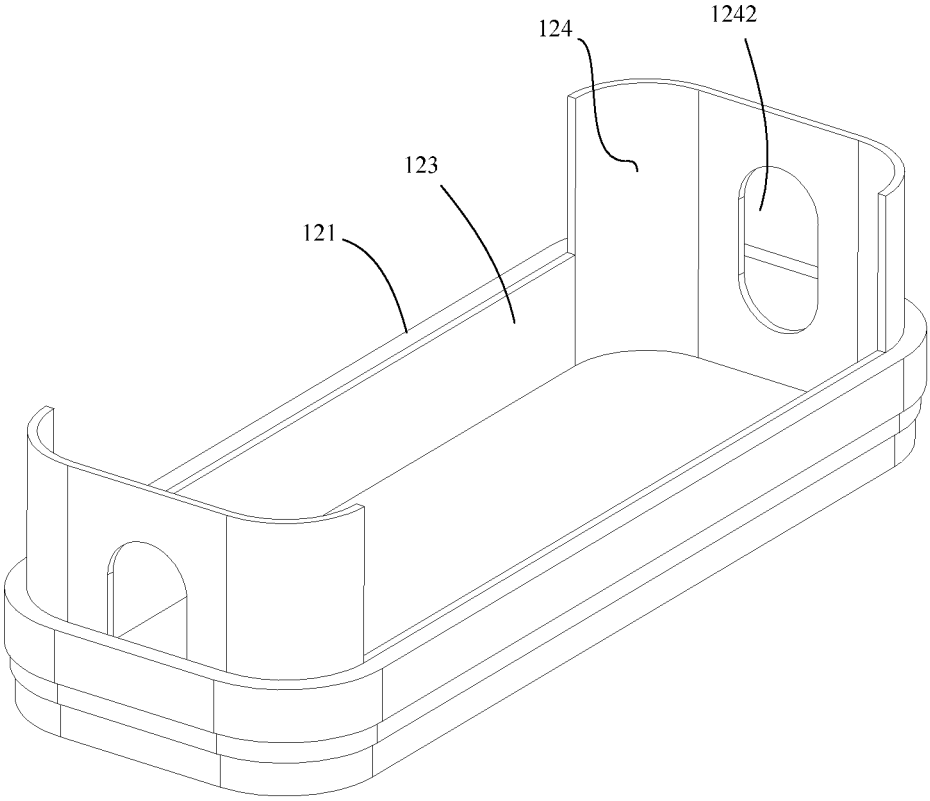
FIG. 17 is a schematic view of the bobbin voice coil of the sound device according to an eighth embodiment of the present disclosure.

As shown in FIG. 16 and FIG. 17, in order to reduce the weight of the bobbin voice coil 12, according to a seventh embodiment of the present disclosure, at least one opening 1232 is provided on a side wall of the supporting portion 123, and there are two openings 1232 shown in the figures. Further, according to an eighth embodiment of the present disclosure, at least one avoiding hole 1242 is defined on a side wall of the connecting portion 124. Through the above design, the weight of the bobbin voice coil 12 is reduced, thereby improving the acoustic performance and reducing the manufacturing cost. It can be understood that the design of the avoiding hole 1242 can also be more conducive to the air circulation in the first acoustic cavity 5 and the second acoustic cavity 6, reducing the pressure difference, thereby further improving the acoustic performance.

Further, based on the above structure, an end surface of the supporting portion 123 away from the first diaphragm 11 is flush with an end surface of the voice coil body 121 away from the first diaphragm 11, or an end surface of the supporting portion 123 away from the first diaphragm 11 is not higher than an end surface of the voice coil body 121 away from the first diaphragm 11. That is, the position of the voice coil body 121 on the bobbin 122 can be adjusted. As such, it is convenient for the performance debugging of the sound device 200 during the assembly process. For example, the bobbin voice coil is approximately rectangular, and the bobbin 122 is approximately rectangular. The bobbin 122 includes two long sides and two short sides, and the long sides and short sides are alternately arranged. The connecting portion 124 may be disposed on the short side, and at this time, the connecting portion 124 protrudes from the long side. The voice coil leads can be wound on the bobbin 122 to form the voice coil body. At this time, the voice coil body can be flush with the long side of the bobbin 122.

Figure 6:
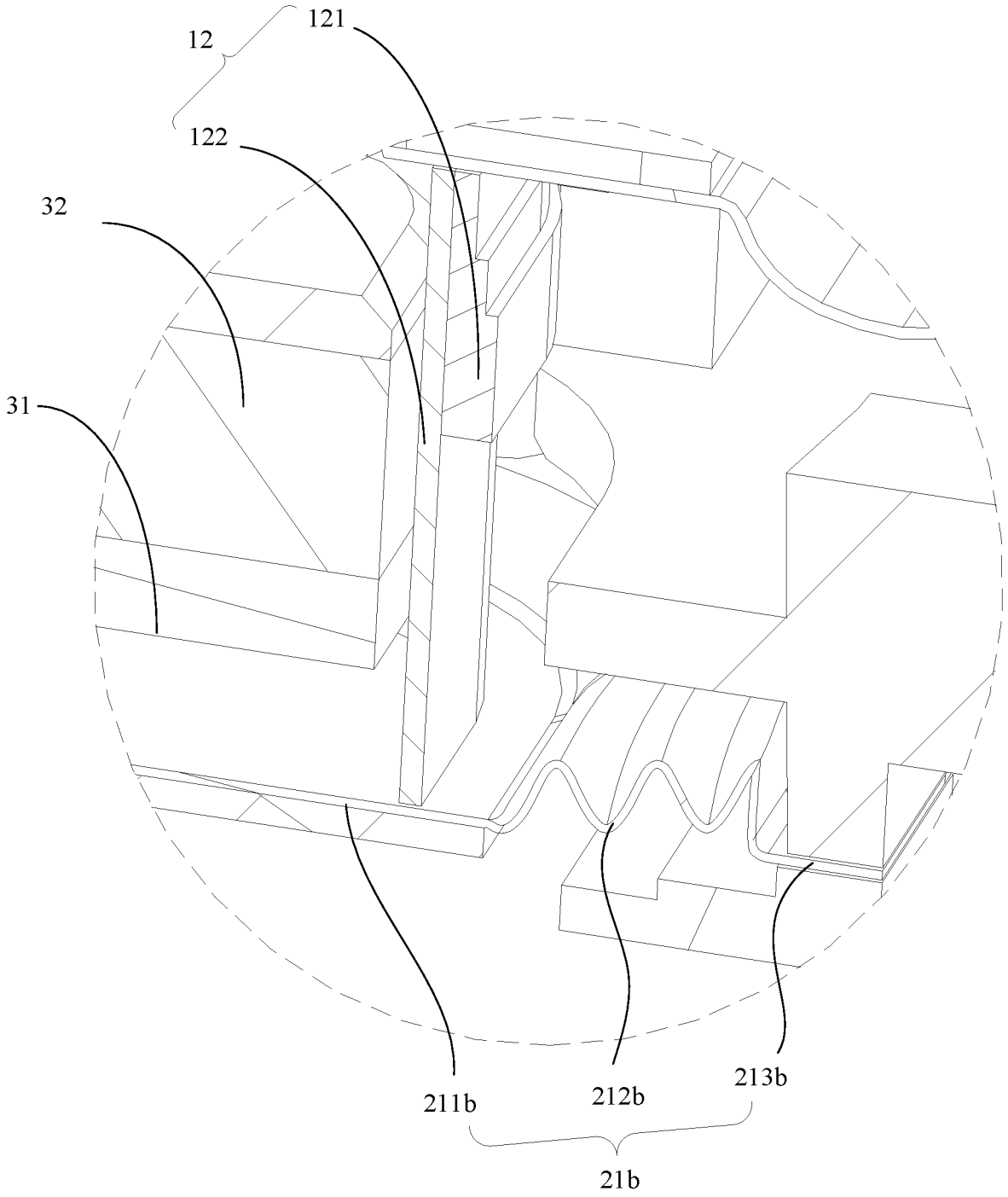
FIG. 6 is an enlarged view of a right end of the structure in FIG. 4, where the first embodiment of a second diaphragm is replaced with a second embodiment of the second diaphragm.

Further, as shown in FIG. 6 and FIG. 7, the second diaphragm (21*a*, 21*b*) includes a center portion (211*a*, 211*b*), a folding ring portion (212*a*, 212*b*) around the center portion (211*a*, 211*b*), and a fixing portion (213*a*, 213*b*) around the folding ring portion (212*a*, 212*b*). The center portion (211*a*, 211*b*) is a flat sheet structure. According to a first embodiment and a second embodiment, the folding ring portion 212*a* is a structure composed of a protrusion, or the folding ring portion 212*b* is a wave-shaped structure composed of at least one protrusion and at least one recess.

In this embodiment, the center portion (211*a*, 211*b*) is used to bear the force of the bobbin 122, then vibrates and produces sound, namely be linked to sound radiation. The center portion (211*a*, 211*b*) is set as a flat sheet structure, so that the second diaphragm (21*a*, 21*b*) occupies a small space in the vertical direction. The lower surface of the connecting portion 124 and the center portion (211*a*, 211*b*) have a larger contact area, and the connecting structure is stable and can generate a sufficiently large amplitude.

Further, the second diaphragm (21*a*, 21*b*) further includes a composite layer (not labeled) combined with the center portion (211*a*, 211*b*). The lower end of the connecting member (4*a*-4*e*) is fixedly connected to the composite layer or the center portion (211*a*, 211*b*). The composite layer can increase the rigidity of the second diaphragm 21*c* and ensure the high frequency performance of the second diaphragm (21*a*, 21*b*). In an embodiment, in order to ensure better acoustic performance of the passively radiated second diaphragm (21*a*, 21*b*), the composite layer is made of a material with a higher specific modulus, such as aluminum composite material, aluminum, aluminum-magnesium alloy, magnesium-lithium alloy material, carbon fiber, polyethylene naphthalate (PEN), Liquid Crystal Polymer (LCP), foam, etc.

Further, the first diaphragm 11 includes a center portion, a folding ring portion around the center portion, and a fixing portion around the folding ring portion. The center portion of the first diaphragm 11 is a flat sheet structure. According to a first embodiment and a second embodiment, the folding ring portion is a structure composed of a protrusion, or the folding ring portion is a wave-shaped structure composed of at least one protrusion and at least one recess. Similarly, the center portion of the first diaphragm 11 is a flat sheet structure, such that the first diaphragm 11 occupies a small space in the up and down direction, and can generate a sufficiently large amplitude. After combining the embodiment in which the center portion of the second diaphragm (21*a*, 21*b*) is also provided as a sheet structure, the sound device of the present disclosure has a thin structure in the vertical direction as a whole, so that it is easier to be applied to a flat installation space.

Figure 18:
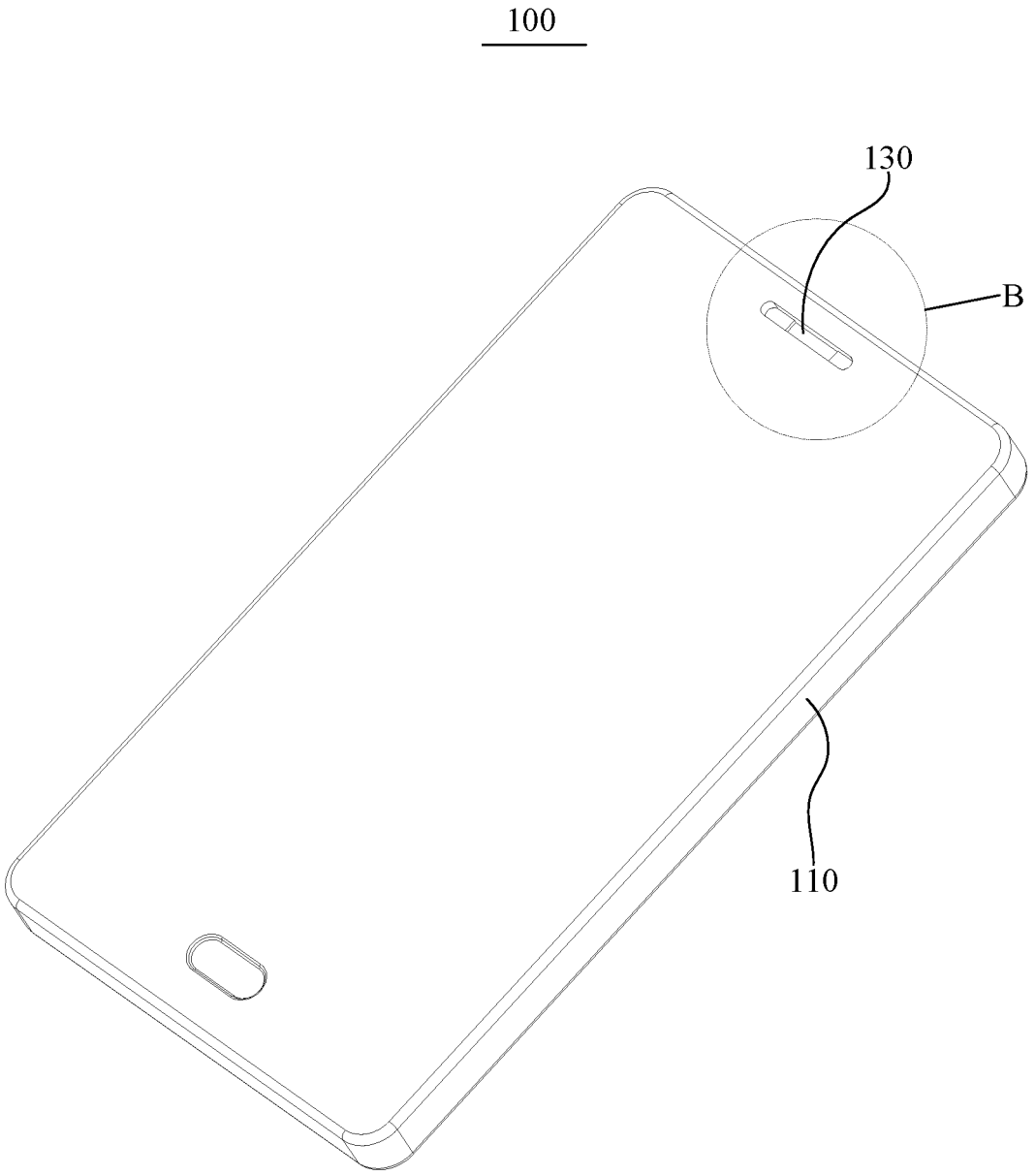
FIG. 18 is a schematic front view of a portable terminal according to an embodiment of the present disclosure.
Figure 19:
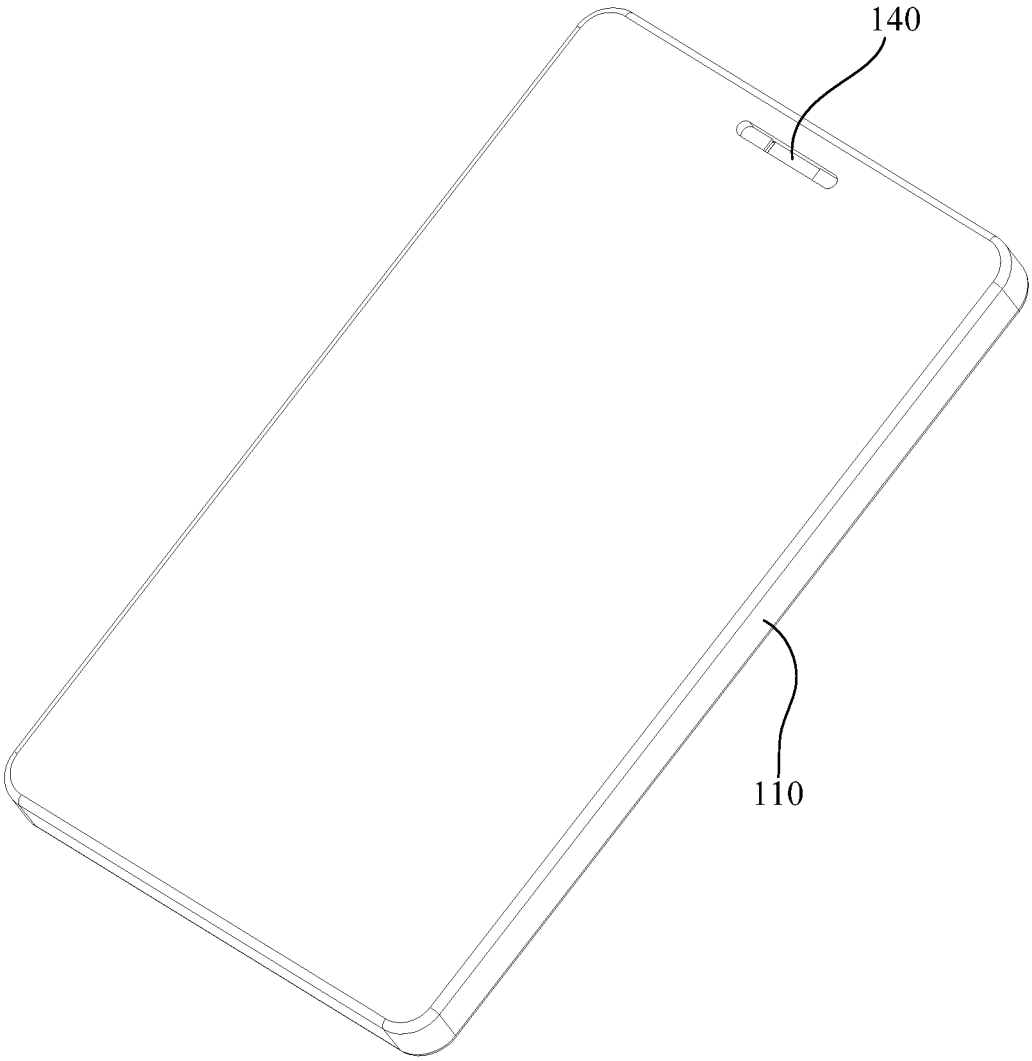
FIG. 19 is a schematic rear view of the portable terminal in FIG. 18.
Figure 20:
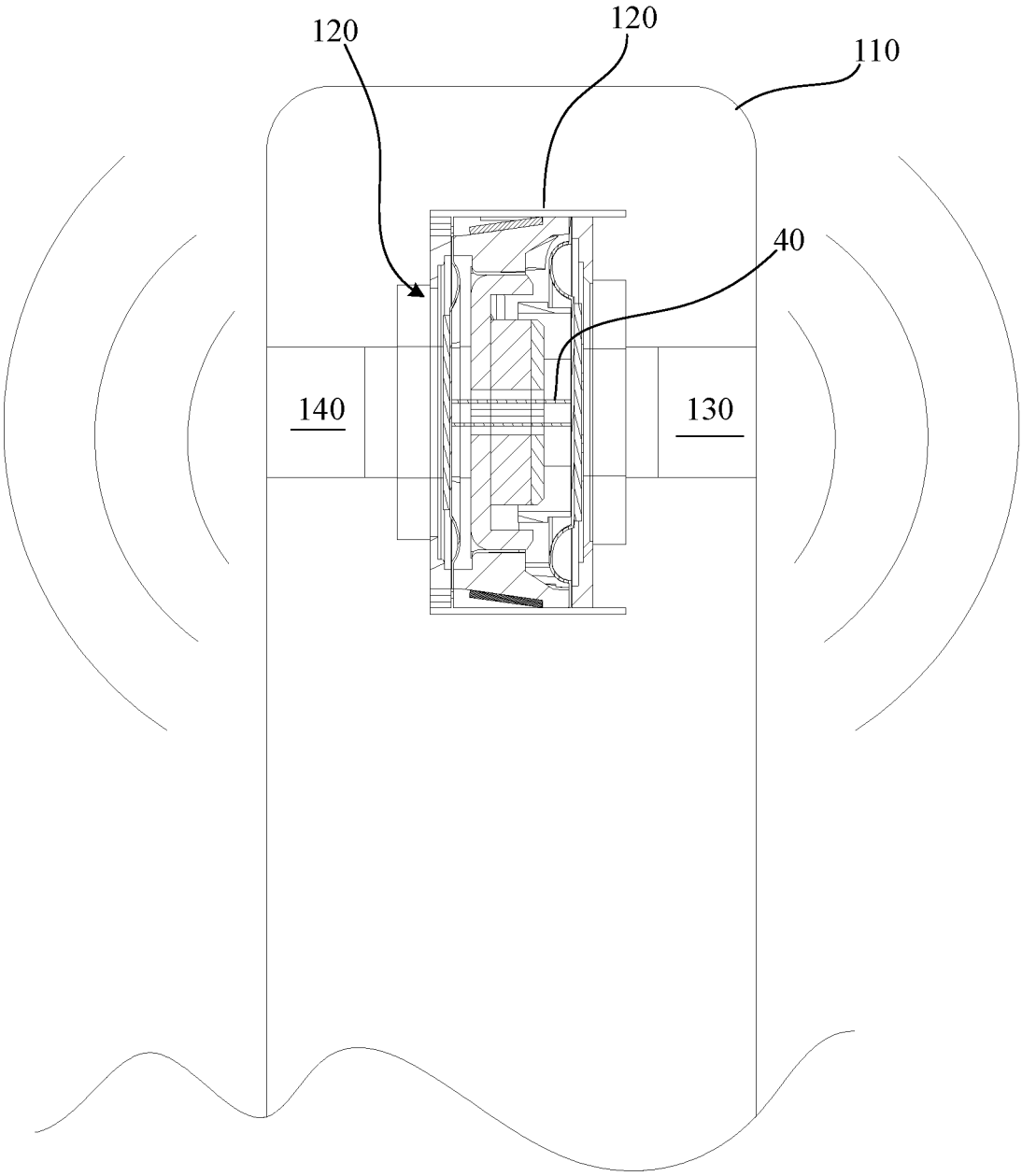
FIG. 20 is a schematic partial cross-sectional view of portion B in FIG. 18.

As shown in FIG. 18 to FIG. 20, the present disclosure further provides a portable terminal 100. The portable terminal 100 includes a housing 110 with a receiving cavity 120 inside. The portable terminal 100 further includes a sound device 210. The specific structure of the sound device 210 refers to the foregoing embodiments. Since the portable terminal 100 adopts all the technical solutions of all the foregoing embodiments, it has at least all the beneficial effects brought about by the technical solutions of the foregoing embodiments, which will not be repeated here. The sound device 210 is installed in a receiving cavity 120. The housing 110 is provided with a first sound hole 130 corresponding to a first diaphragm 11 and a second sound hole 140 corresponding to a second diaphragm (21*a*, 21*b*). In an embodiment, in order to shorten the propagation path of sound inside the housing 110 and reduce the acoustic resistance, the first sound hole 130 is defined in a position of the housing 110 that is directly opposite to the first diaphragm 11, and the second sound hole 140 is defined in a position of the housing 110 that is directly opposite to the second diaphragm (21*a*, 21*b*).

Further, the housing 110 includes a front surface and a back surface opposite to the front surface, the first sound hole 130 is provided on the front surface, and the second sound hole 140 is provided on the back surface.

The above are only some embodiments of the present disclosure, and do not limit the scope of the present disclosure thereto. Under the inventive concept of the present disclosure, equivalent structural transformations made according to the description and drawings of the present disclosure, or direct/indirect application in other related technical fields are included in the scope of the present disclosure.

What is claimed is:

1. A sound device, comprising:

a first vibration system including a bobbin voice coil, the bobbin voice coil being provided behind a first diaphragm and fixedly connected to the first diaphragm, the bobbin voice coil including a bobbin and a voice coil body formed by winding voice coil leads on the bobbin, one end of the bobbin away from the first diaphragm at least partially configured to protrude from the voice coil body;

a second vibration system including a second diaphragm opposite to the first diaphragm; and a magnetic circuit system between the first diaphragm and the second diaphragm, the magnetic circuit system being provided with an avoiding portion, wherein one end of the bobbin away from the first diaphragm is movable to penetrate through the avoiding portion and is fixedly connected to the second diaphragm;

the magnetic circuit system includes a magnetic conductive yoke and a center magnetic circuit portion and a side magnetic circuit portion provided on the magnetic conductive yoke;

a magnetic gap for receiving the bobbin voice coil is provided between the center magnetic circuit portion and the side magnetic circuit portion; and the magnetic conductive yoke includes two long sides pposite to each other and two short sides, the long side and the short side are spaced apart, the center magnetic circuit portion is located in a middle of the magnetic conductive yoke, the side magnetic circuit portions is located on opposit sides of the center magnetic circuit portion and extending along, the long sides, a position of the magnetic conductive yoke corresponding to each of the two short sides is provided with an avoiding notch to form an avoiding portion, and the bobbin includes a supporting portion and a connecting portion, the supporting portion is wound with the voice coil leads to form the voice coil body, the connecting portion is connected to the supporting portion and protruded from the voice coil body, and the connecting portion is configured to pass through the avoiding notch and is fixedly connected to the second diaphragm.

2. The sound device of claim 1, wherein:

at least one of the center magnetic circuit portion and the side magnetic circuit portion is provided with a permanent magnet.

3. The sound device of claim 1, wherein a first acoustic cavity is provided between the magnetic circuit system and the first diaphragm, a second acoustic cavity is provided between the magnetic circuit system and the second diaphragm, and the avoiding portion is in communication with the first acoustic cavity and the second acoustic cavity.

4. The sound device of claim 1, wherein a side wall of the connecting portion is folded towards inside the bobbin and/or towards outside the bobbin to form a connecting flange, and a bottom surface of the connecting flange away from the supporting portion is fixedly connected to the second diaphragm.

5. The sound device of claim 4, wherein a plurality of connecting flanges are spaced apart, and folding directions of two adjacent connecting flanges are identical or different.

6. The sound device of claim 1, wherein a side wall of the supporting portion is folded towards inside the bobbin and/or towards outside the bobbin to form a mounting flange, and a bottom surface of the mounting flange away from the connecting portion is fixedly connected to the first diaphragm.

7. The sound device of claim 1, wherein an end surface of the supporting portion close to the first diaphragm is flush with an end surface of the voice coil body close to the first diaphragm, or an end surface of the supporting portion close to the first diaphragm is higher than an end surface of the voice coil body close to the first diaphragm.

8. The sound device of claim 1, wherein an end surface of the supporting portion away from the first diaphragm is flush with an end surface of the voice coil body away from the first diaphragm, or an end surface of the supporting portion away from the first diaphragm is not higher than an end surface of the voice coil body away from the first diaphragm.

9. The sound device of claim 1, wherein an opening is further provided on a side wall of the supporting portion.

10. The sound device of claim 1, wherein an avoiding hole is further provided on a side wall of the connecting portion.

11. The sound device of claim 1, wherein:

the first diaphragm includes a center portion, a folding ring portion around the center portion, and a fixing portion around the folding ring portion; and the center portion is a flat sheet structure, the folding ring portion is a structure composed of a protrusion, or the folding ring portion is a wave-shaped structure composed of at least one protrusion and at least one recess.

12. The sound device of claim 1, wherein:

the second diaphragm includes a center portion, a folding ring portion around the center portion, and a fixing portion around the folding ring portion; and the center portion is a flat sheet structure, the folding ring portion is a structure composed of a protrusion, or the folding ring portion is a wave-shaped structure composed of at least one protrusion and at least one recess.

13. A portable terminal, comprising a housing with a receiving cavity inside and the sound device of claim 1, wherein the sound device is installed in the receiving cavity, the housing is defined with a first sound hole corresponding to the first diaphragm and a second sound hole corresponding to the second diaphragm.

14. The portable terminal of claim 13, the housing includes a front surface and a back surface opposite to the front surface, the first sound hole is provided on the front surface, and the second sound hole is provided on the back surface.

* * * * *